United States Patent [19]

Allen

[11] 4,159,671

[45] Jul. 3, 1979

[54] SELF-ADVANCING MINE ROOF SUPPORTS

[76] Inventor: Archelaius D. Allen, 6 Brookdale Close, Leyland, Preston, England

[21] Appl. No.: 857,016

[22] Filed: Dec. 2, 1977

Related U.S. Application Data

[63] Continuation of Ser. No. 592,997, Jul. 3, 1975, abandoned.

[30] Foreign Application Priority Data

Aug. 20, 1974 [GB] United Kingdom ..... 36490/74

[51] Int. Cl.[2] ..... F15B 13/04; F15B 11/00

[52] U.S. Cl. ..... 91/32; 91/170 MP; 91/427; 91/460; 91/461; 91/527; 405/302

[58] Field of Search ..... 91/32, 170 MP, 414, 91/427, 460, 461; 61/45 D; 60/571

[56] References Cited

U.S. PATENT DOCUMENTS

| | | | |
|---|---|---|---|
| 2,146,030 | 2/1939 | Schjolin | 60/571 |
| 3,306,050 | 2/1967 | Andrews | 61/45 D |
| 3,320,001 | 5/1967 | Allen | 61/45 D |
| 3,541,926 | 11/1970 | Grebe | 61/45 D |
| 3,821,880 | 7/1974 | Weirich | 61/45 D |
| 3,906,738 | 9/1975 | Weirich | 61/45 D |

*Primary Examiner*—Martin P. Schwadron
*Assistant Examiner*—Abraham Hershkovitz
*Attorney, Agent, or Firm*—Berman, Aisenberg & Platt

[57] ABSTRACT

A self-advancing mine roof support is provided, in addition to the normal manually operable control valve means for controlling raising and lowering of the roof-engaging structure of the support and operation of the advancing means, with an automatic sequence control valve means operable in response to a control signal from a position removed from the support, for example from an adjacent support, and an isolating valve means arranged so that control of the various operations can be effected either by means of the manually operable means or from the safety of a location spaced away from the support being controlled by means of the automatic valve means each independently of the other.

7 Claims, 2 Drawing Figures

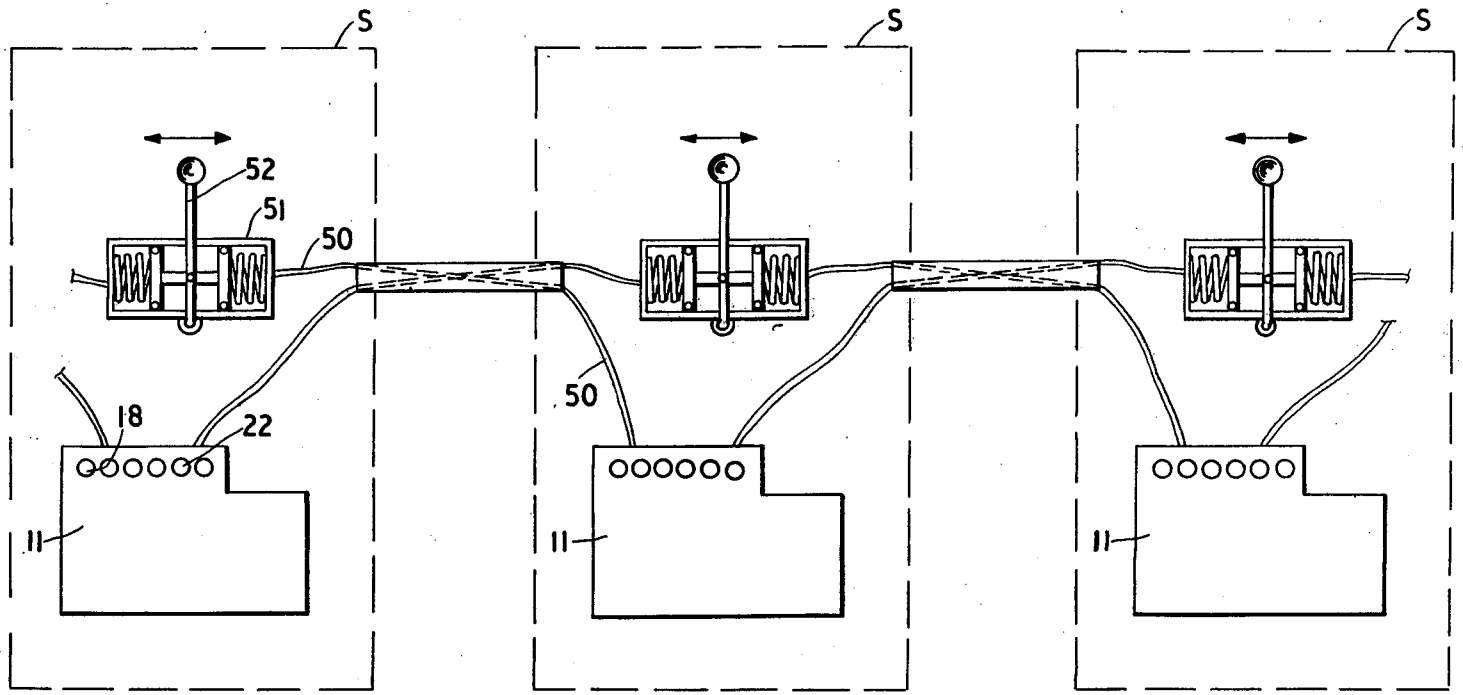
—FIG. 2—

SELF-ADVANCING MINE ROOF SUPPORTS

This is a continuation of application Ser. No. 592,997 filed July 3, 1975 now abandoned.

This invention is for improvements in or relating to control means for self-advancing mine roof supports. The invention is particularly, but not exclusively, concerned with mine roof support systems of the kind (hereinafter referred to as the kind specified) in which each of a series of supports or chocks, arranged in side-by-side relationship along a mineral face, comprises hydraulically extensible prop means and a pressure fluid ram for advancing the support as winning of mineral from the mineral face proceeds. The support advancing ram may also serve to advance the conveyor by which the mineral is carried away from the face, the ram, which is double-acting, then using the conveyor as an anchorage to advance the support. Alternatively the support may comprise two units to which the cylinder and piston of the ram are connected respectively. In this case each unit in turn acts as an anchorage or abutment for the advance of the other when the latter has been temporarily released from between roof and floor of the mine working.

It is convenient to control the raising and lowering of the prop means and the extension and retraction of the support advancing ram by a multi-ported control valve having an operating member (e.g. a handle) which is moved to one of a plurality of different positions according to the operation it is required should take place. Preferably the operating member of the valve is in the form of a dead man's handle which has to be depressed or raised against the action of a spring as well as turned to obtain the desired flow of fluid through the valve.

One object of the present invention is to incorporate in a roof support control valve arrangement, as just described, means whereby the operation of one or a bank of roof supports can be caused to take place automatically by the operation of a control valve on an adjacent or remotely located roof support in the roof support system or at some other remote station in the mine working. Thus, a mine worker can advance and re-set a roof support or bank of supports whilst safely protected under an adjacent or remotely located support, or without being actually at the face.

According to the present invention there is provided a self-advancing mine roof support having means for controlling the advance thereof comprising a manually operable sequence step control valve and an automatic sequence control valve operable in response to a control signal from a position removed from the support, both said control valves being adapted to control the sequence of operations required to be performed to advance said support, and isolating valve means arranged so that either of said control valves can effect advance of said support independently of the other.

The sequence of operations to be performed may, for example, be the lowering and advancing or the lowering, advancing and re-setting of the support with or without the extension or retraction of hydraulic spacer-rams between neighbouring supports.

The automatic sequence control valve may be arranged to initiate the operations necessary to lower and advance the support and resetting of the support to the roof, after it has been advanced, may be controlled by a striker valve which is operated by the support advancing ram at or towards the end of the advancing operation.

Preferably the manually operable valve, the automatic sequence control valve and the shuttle valves or equivalent valve means are combined in a single valve block or unit.

Conveniently the automatically acting valve is responsive to a pressure fluid (e.g. hydraulic) signal but it may be responsive to an electric, radio or other signal.

The invention will be further described, by way of example, with reference to the accompanying drawings in which:

FIG. 2 is a schematic diagram showing the arrangements for controlling a support from the support on either side of it in a row of adjacent supports.

Figure 1:
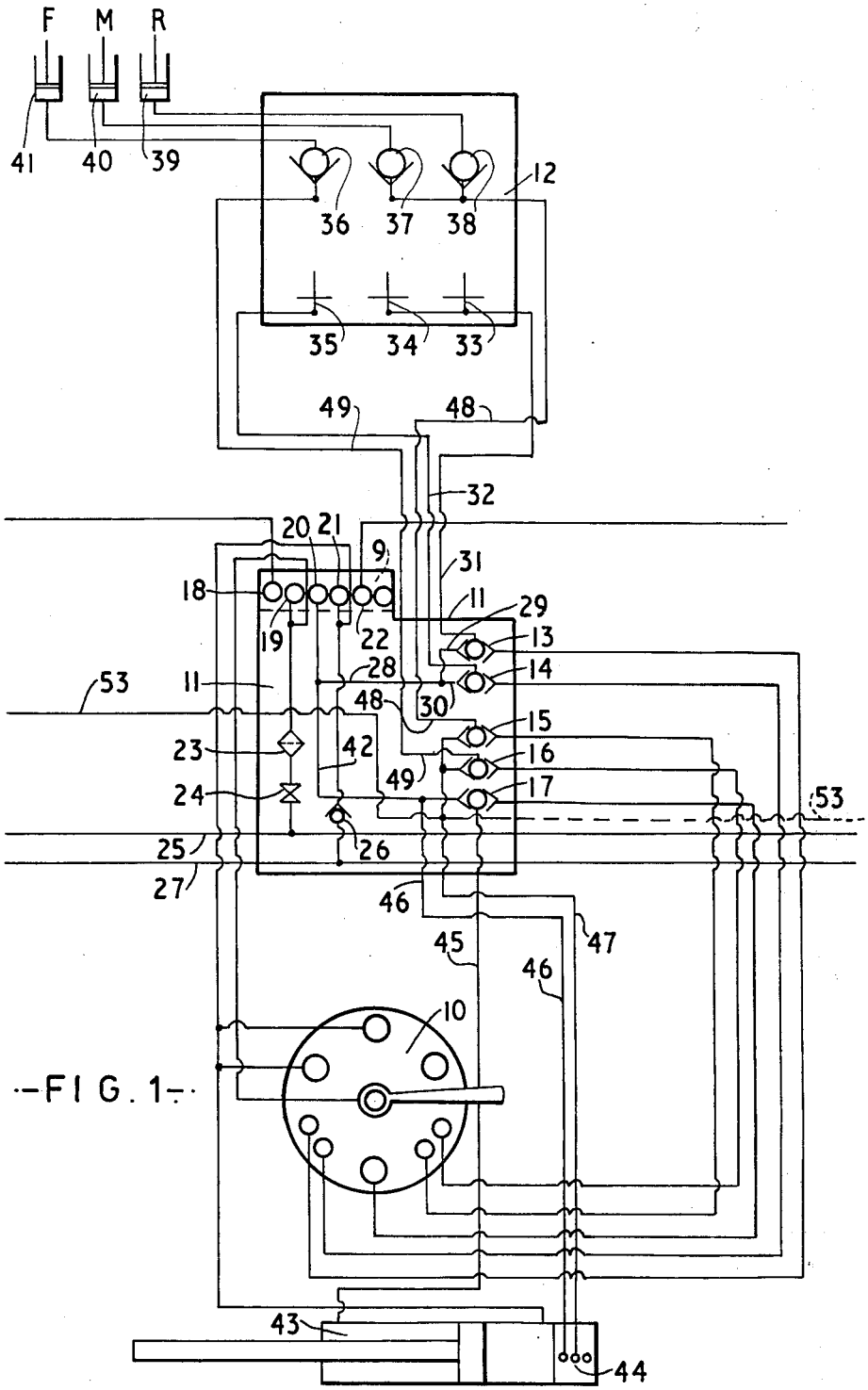
FIG. 1 is a diagram of an hydraulic control system for mine roof supports.

The arrangement shown in FIG. 1 comprises a multi-ported control valve 10 which may, for example, be constructed as described in the Specification of our British Pat. No. 1,261,129, and be arranged to control the operation of the roof support, on which it is mounted, in the well known way or as described, for example, in the Specification of U.S. application Ser. No. 560,723 dated Mar. 21, 1975, in the name of John Cooke and Derek Alker now U.S. Pat. No. 3,991,578.

For the purpose of the present invention the hydraulic control system includes an auto-control valve block 11 which may be an interface unit between the control valve 10 and an isolating non-return valve manifold 12 so that these three items form a complete valve block. There will be additional hydraulic manifolds on the conveyor advancing (e.g. pusher) supports if they are part of a bank pushing or remote snaking system.

The auto-control valve block 11 comprises a manifold with five built-in shuttle valves 13, 14, 15, 16 and 17 and a pilot operated flow control valve 9 having ports 18, 19, 20, 21 and 22. The valve block may also house a filter 23, a feed line isolating valve 24, in the feed from line 25, and a non-return valve 26 in the return to return line 27. The valve block includes a solenoid valve mounting face for use in electrically initiated systems.

The shuttle valves 13–17 are provided to allow override of the automatic system and the control of each individual support by its own dead man's handle control valve 10.

The pilot operated flow control valve 9 in the valve block 11, is the basis of operation for automatic support advance. By applying a hydraulic signal to either port 18 or 22 of the pilot valve, lowering and advancing of the support is caused automatically to take place. The provision of the two ports 18 and 22 makes the system bi-directional i.e. a support may be operated from a hydraulic signal coming from a support on its right or from a support on its left.

Assuming that a hydraulic signal is applied to the port 18, the pilot flow control valve 9 will then move so as to connect the feed line 25 via the port 19 to the port 20. There will then be a full flow of hydraulic fluid via the lines 28, 29 and 30 and the shuttle valves 13 and 14 and lines 31 and 32 respectively to pressure fluid operated strikers 33, 34 and 35. Said strikers will then positively open non-return valves 36, 37 and 38 associated with the rear, middle and front hydraulic props 39, 40 and 41 of the support. Pressure fluid is then exhausted from the props. Thus, the support is lowered from the roof. At the same time there is a fluid flow from the port 20 via the line 42 and shuttle valve 17 to the retract side of the support advancing ram 43. The latter is connected to the mineral face conveyor, which has previously been advanced, in the usual way, so that when the ram is retracted the support is advanced up to the face conveyor. When it is fully retracted the piston of the advancing ram operates a striker valve 44 and fluid is then fed from the port 20 to the props 39, 40 and 41, to re-set the support to the roof, via lines 42 and 46, striker valve 44, line 47 shuttle valves 15 and 16, lines 48 and 49 and non-return valves 36, 37 and 38.

A similar sequence of events takes place when a hydraulic signal is applied to the port 22.

The individual steps of such sequence can also be individually controlled by selective operation of the dead man's handle of the manual sequence step control valve 10. In this connection the shuttle valves 13 to 17 serve to isolate the advancing ram control lines 45, 46, 47 and the prop control lines 31, 32 and 48, 49 from the pilot flow control valve 9 when step-by-step control is being effected by the manually operable valve 10 on the support. These valves 13 to 17 also serve to isolate such lines from the manually operable valve 10 when automatic sequence control is being effected by the valve 9 in response to a signal from an adjacent support or a more remote location.

An auto-bank system outlet line 53 may be provided to be used to initiate automatic sequence of operations of the next support or bank of supports in a series. The hydraulic props 39, 40 and 41 may be made double-acting by, for example, a suitable re-arrangement of the strikers 33, 34 and 35 and connections to the retract sides of the props. Advance of a support with respect to the lowering of its props may be delayed by, for example, an arrangement similar to that described in the Specification of our British Pat. No. 1,228,381.

Hydraulic signals may be applied to the port 18 or 22 in various ways of which the following are examples:

1. In the arrangement shown in FIG. 2, each support, indicated by a broken line rectangle S, has a closed loop hydraulic system 50 which includes spring-loaded piston-and-cylinder pressurising devices 51 serving as hydraulic signal generators and controlled by a dead man's operating handle or lever 52. The hydraulic system 50 of each support S is connected to the port 18 of the auto-control valve block 11 of the support adjacent on the right hand side and to the port 22 of the valve block 11 of the support adjacent on the left hand side. By moving the handle 52 to the left the relevant port 22 will be pressurised and by moving it to the right the relevant port 18 will be pressurised. In both cases the supports to be operated will lower, advance and automatically re-set. Each support may thus be controlled by the system 50 of an adjacent support on either side or by appropriate connections of the systems 50 from a more remotely positioned support in the roof support system.
2. For the automatic advance and resetting of a bank or row of supports, operation of the first support in the bank could be initiated by the closed loop lever system described in (1) above. When the first support has been advanced and a suitable re-setting pressure has been achieved a hydraulic element of said first support transmits a signal over line 53 to the port 18 of the auto-control valve block 11 of the next support which is then advanced and re-set automatically as above described and so on to the end of the bank. The manner in which the signals are provided may be as described in the Specification of our U.K. Pat. No. 1,038,262.
3. Operation of banks of supports on either side of an initiating support could be effected in one direction as described in (2) above and in the opposite direction and in a similar manner by pressurising the port 22 of the auto-control valve block of the next support in the other direction.
4. For a fully remote system the supply of pressure fluid to the ports 18 and 22 could be under the control of solenoid valves operable by means of a remote control electrical system. Such a system may be as described in the Specification of our U.K. Pat. Nos. 1,121,541 and 1,121,542. The arrangement may be such that the supports are controlled in banks or individually by the remote control system. The arrangement may incorporate features of Examples (1), (2) and (3) above.
5. The solenoid valves of Example (4) above may be operated by a radio remote control system. The transmitter of such a system could be carried on the mineral cutting or winning machine and would initiate support advance at some distance behind the machine as it moves along the mineral face. The sequence of support advance to suit cutting in either direction could be changed by changing the transmitter frequency.

It will be appreciated from the above description that the invention can provide for:

(1) Individual control of supports.
(2) Control from one support of an adjacent support on one or both sides of it.
(3) Control from one support of an adjacent support on one or both sides of it with automatic re-setting.
(4) Bank control of supports in one direction along a mineral face.
(5) Bank control of supports in opposite directions along a mineral face.
(6) Full remote operation, electrically initiated and monitored, using short banks of supports.
(7) Full remote operation, electrically initiated and monitored, with each support individually electrically initiated.
(8) Radio initiated support advance.

I claim:

1. A self-advancing mine roof support system which comprises a plurality of mine roof supports arranged side-by-side and means for passing an automatic sequencing control signal between adjacent supports; each of said supports including manually operable control valve means, an automatic sequence control valve means operable in response to said control signal passed thereto, each of said manually operable and automatic sequence control valve means providing for controlling the operations of the support, isolating valve means arranged so that either one of said manually operable control valve means and said automatic sequence control valve means can effect operation of said support independently of the other, and a manually operable signal generator means operable independently of either of said control valve means and arranged to apply an output signal to the automatic sequence control valve means of a next adjacent support to permit selective control of that next adjacent support through an automatic advance sequence thereof.

2. A self-advancing mine roof support system as claimed in claim 1 wherein each of said supports includes hydraulic operating circuitry and wherein said isolating valve means responds to the operation of one of said control valve means to connect said one control valve means with said hydraulic operating circuitry of said support and to isolate the remaining control valve means from said circuitry.

3. A self-advancing mine roof support system as claimed in claim 1 wherein said automatic sequence control valve means includes means for controlling the lowering and advancing operations of said support, and means for resetting said support after advancing is effected automatically in response to the completion of the advancing operation independently of said automatic sequence control valve means.

4. A system as claimed in claim 1 wherein the manually operable control signal generator of at least one of said supports is selectively operable to apply control signals to the automatic sequence control valve means of the support positioned on either side thereof whereby its advance can be controlled stepwise from said support itself and in an automatic sequence from the support positioned on either side thereof.

5. A system as claimed in claim 1 wherein means are provided for applying a control signal to the automatic sequence control valve means of at least one support from a next adjacent support upon completion of an automatic advancing sequence by said next adjacent support whereby automatic advance of said at least one support automatically follows the automatic advance of said next adjacent support.

6. A mine roof support system as claimed in claim 1 wherein said automatic sequence control valve means are adapted to respond to hydraulic control signals.

7. The self-advancing mine roof support system as set forth in claim 1, wherein said manually operable control signal generator means includes control signal initiating means normally biased to a neutral state but manually actuable to either of two signal generation states each of which relates to a different but adjacent support.

* * * * *